United States Patent [19]

Sakashita

[11] Patent Number: 4,915,008

[45] Date of Patent: Apr. 10, 1990

[54] AIR FLOW RESPONSE TYPE ELECTRONIC MUSICAL INSTRUMENT

[75] Inventor: Shigeo Sakashita, Hamura, Japan

[73] Assignee: Casio Computer Co., Ltd., Tokyo, Japan

[21] Appl. No.: 256,770

[22] Filed: Oct. 11, 1988

[30] Foreign Application Priority Data

Oct. 14, 1987 [JP] Japan ..... 62-259294
Dec. 31, 1987 [JP] Japan ..... 62-200109[U]

[51] Int. Cl.[4] ..... G10H 1/14; G10H 1/46

[52] U.S. Cl. ..... 84/658; 84/659; 84/735; 84/741; 84/742

[58] Field of Search ..... 84/1.01, 1.04–1.16, 84/1.24–1.27, 653, 658–662, 665, 735–737, 741, 742

[56] References Cited

U.S. PATENT DOCUMENTS

| | | | |
|---|---|---|---|
| 2,138,500 | 10/1936 | Miessner . | |
| 2,301,184 | 1/1941 | Arnold . | |
| 2,868,876 | 6/1952 | Ticchioni . | |
| 3,429,976 | 5/1966 | Tomcik . | |
| 3,439,106 | 1/1965 | Goodale . | |
| 3,767,833 | 10/1973 | Noble et al. . | |
| 3,938,419 | 2/1976 | De Rosa | 84/1.14 |
| 4,085,646 | 4/1978 | Naumann | 84/1.09 |
| 4,151,368 | 4/1979 | Fricke et al. | 84/1.01 X |
| 4,168,645 | 9/1979 | Squire et al. | 84/1.01 |
| 4,274,321 | 6/1981 | Swartz | 84/1.09 X |
| 4,418,599 | 12/1983 | Raskin | 84/1.09 X |
| 4,757,737 | 7/1988 | Conti . | |

FOREIGN PATENT DOCUMENTS

| | | |
|---|---|---|
| 57-42094 | 3/1982 | Japan . |
| 59-15099 | 1/1984 | Japan . |
| 60-4994 | 1/1985 | Japan . |
| 62-164094 | 7/1987 | Japan . |
| 63-29192 | 2/1988 | Japan . |

*Primary Examiner*—Stanley J. Witkowski
*Attorney, Agent, or Firm*—Frishauf, Holtz, Goodman & Woodward

[57] ABSTRACT

A breath detection signal from a breath sensor section is converted to a digital breath detection signal, and when the value of the detection signal exceeds a preset value, a tone is generated. After the tone generation, a tone parameter of the tone being generated is controlled according to the value of said digital breath detection signal. When a predetermined period of time is elapsed from an instant when the digital breath detection signal exceeds a preset signal, initial breath data is generated in correspondence to the breath detection signal or preset value at that instant. The tone parameter of the tone at the time of the tone generation is controlled according to initial breath data. After the generation of the tone, the tone parameter of the tone being sounded is controlled according to after-breath data corresponding to the breath detection signal. The pitch determination of the tone to be generated is performed by a pitch designation operation section provided on a musical instrument body having a mouthpiece input section.

22 Claims, 7 Drawing Sheets

| A/D DATA | CONVERTED INITIAL DATA |
|---|---|
| 0 | 0 |
| 1 | 0 |
| 2 | 0 |
| 10 | 1 |
| 11 | 3 |
| 12 | 6 |
| 13 | 9 |
| 14 | 12 |
| 15 | 15 |
| 20 | 30 |
| 21 | 32 |
| 22 | 34 |
| 23 | 36 |
| 24 | 38 |
| 25 | 40 |

| A/D DATA | CONVERTED INITIAL DATA |
|---|---|
| 81 | 93 |
| 82 | 94 |
| 83 | 95 |
| 84 | 96 |
| 85 | 97 |
| 86 | 98 |
| 87 | 99 |
| 88 | 100 |
| 120 | 124 |
| 121 | 124 |
| 122 | 125 |
| 123 | 125 |
| 124 | 126 |
| 125 | 126 |
| 126 | 127 |
| 127 | 127 |

AIR FLOW RESPONSE TYPE ELECTRONIC MUSICAL INSTRUMENT

BACKGROUND OF THE INVENTION

1. Field of the Invention

This invention relates to an electronic wind instrument and, more particularly, to an electronic wind instrument which generates desired musical tones in response to breath information generated according to breath operations of the player.

2. Description of the Related Art

In the field of keyboard musical instruments, electronic musical instruments with a commonly termed touch-response function are well known in the art. The function which is presently called the touch-response function is one of generating initial touch data or after-touch data according to the key depression speed when a key on the keyboard is operated or a key depression force when the key is further depressed after the key depression operation and controlling the tone volume or tone color of the tone to be generated according to these two data. In the electronic keyboard musical instrument with such a function at the instant of commencement of key depression key-"on" data generated at this time and initial touch data corresponding to the key depression speed are supplied to a tone source, and a predetermined tone is generated with a volume corresponding to the initial touch data when the key-"on" data is provided. When the key having been operated is further depressed after the commencement of tone generation, after-touch data generated according to the key depression force is supplied again to the tone source for the control of the volume or the like of the tone being generated according to the after-touch data.

Heretofore, there has been developed an electronic wind instrument, in which the tone generation is controlled according to a breath operation with respect to the mouthpiece. A typical electronic wind instrument of this type is disclosed in U.S. Pat. specification No. 3,767,833.

In such an electronic wind instrument, however, it is not suited to adopt the technique of the touch-response function used for the electronic keyboard instrument incorporated in electronic musical instruments without any modification. If the technique of the touch-response function used for electronic musical instruments is adopted for an electronic wind instrument without any modification, the following problem will arise.

If the technique of the touch-response function used for electronic musical instruments is used without any modification for an electronic wind instrument, at the commencement of a breath operation with respect to the mouthpiece provided on the wind instrument body key-"on" data generated with the commencement of the breath operation and initial breath data representing the breath operation force, i.e., breathing force, are supplied to the tone source, and a predetermined tone is generated at the instance of provision of the key-"on" data with a volume corresponding to the initial breath data. When the breath operation is continued after the commencement of the tone generation, after-breath data generated with the breath operation force is supplied again to the tone source for the control of the volume, etc. of the tone being generated according to the after-breath data.

However, a breath sensor which is usually used for this type of electronic wind instrument has inferior response to the breath operation force of the player. Therefore, even when the player suddenly gives a strong breath operation force from the outset, the breath output level of the breath sensor can not be suddenly raised. Therefore, if the tone volume at the time of the tone generation is determined absolutely on the basis of the sole initial breath data value at the instant when the preset key-"on" value is exceeded as noted above, since the initial breath data at the instant of surpassing of the preset key-"on" value has a comparatively small value, the volume of the tone of at the time of the tone generation is low even when a strong breath operation force is given suddenly from the outset. This means that the breath operation state provided by the player can not be adequately reflected in the volume of the tone to be generated.

Further, with an arrangement that a tone is generated immediately with a volume corresponding to pertinent initial breath data when the preset key-"on" value is exceeded by the breath output value from the breath sensor, an unnecessary tone will be generated against the will of the player with a noise breath output produced by a casual breathing or the like other than a breath output produced on the basis of a breath operation by the player.

With the electronic wind instrument disclosed on the U.S. Pat. specification No. 3,767,833, an amplitude modulator is controlled according to an analog breath detection signal detected from a breath sensor, thus generating a tone of a volume corresponding to an analog breath detection signal. Therefore, by gradually increasing the breathing force so that the corresponding analog breath detection signal value is gradually increased, the tone volume level can be proportionally increased. However, with this electronic wind instrument it is possible only to permit the tone volume level to be increased or reduced directly according to and in proportion to the analog breath detection signal. For instance, when the breathing force is gradually increased, the tone volume can not be reduced in proportion to the breathing force, or the tone volume can not be suddenly increased from a predetermined level. Further, it is impossible to alter the contents of the tone color of the tone to be generated according to the breathing force.

SUMMARY OF THE INVENTION

This invention has been intended in order to solve the prior art problems described above, and it has an object of providing an electronic wind instrument, which permits the breath operation state produced by the player to be adequately reflected on a tone parameter of the tone to be generated, e.g., the tone level or tone color contents.

Another object of the invention is to provide an electronic wind instrument, which can prevent generation of an unnecessary tone in response to a noise breath output, if any, produced due to such cause as slight breathing irrelevant to musical performance.

A further object of the invention is to provide an electronic wind instrument, with which, when a breath operation is weak at its commencement and is subsequently done gradually strongly, a tone parameter of the tone to be generated can be controlled in adequate response to the breath operation state.

A still further object of the invention is to provide an electronic wind instrument, which permits adequate variations of a tone parameter of the tone to be generated, e.g., the tone volume level or tone color contents, according to the greath operation state produced by the player, thus permitting wind instrument performance with tones having rich musical contents.

DETAILED DESCRIPTION OF THE PREFERRED EMBODIMENTS

Now, an embodiment of the invention will be described with reference to the drawings.

Overall Outer Structure

Figure 1:
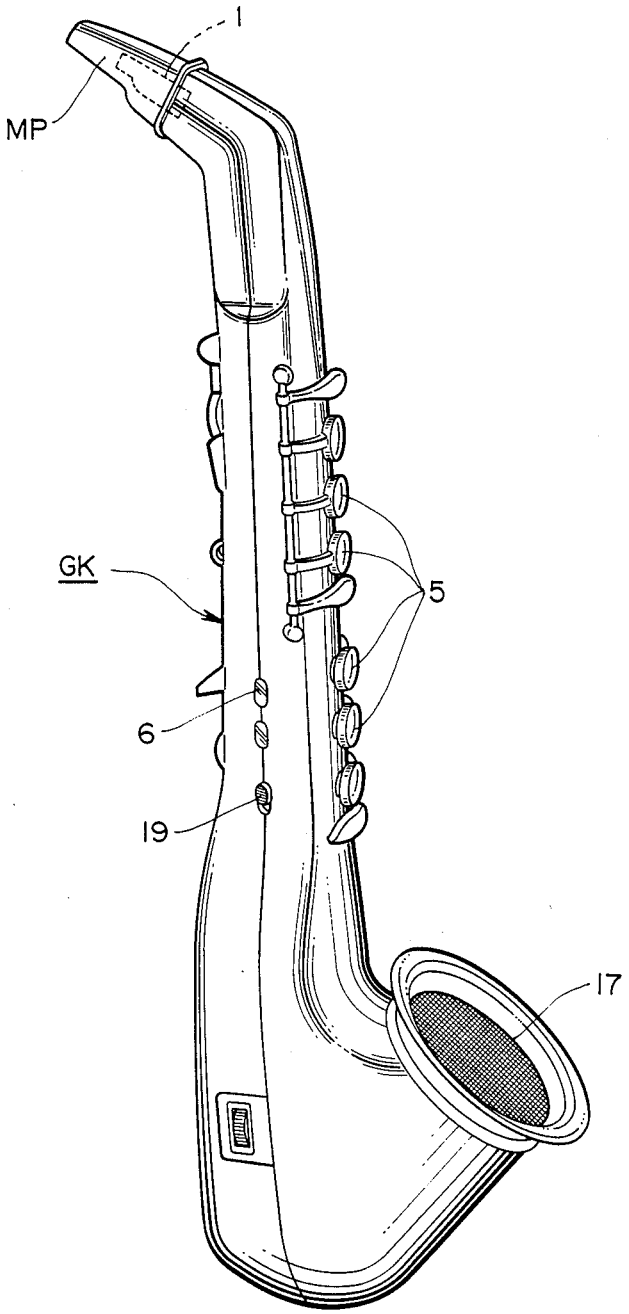
FIG. 1 is a perspective view showing an embodiment of the electronic wind instrument according to the invention.

FIG. 1 is a perspective view showing an embodiment of the electronic wind instrument.

As is shown, wind instrument body KG having a shape like a saxophone has mouthpiece MP, pitch-setting switches 5 and sounding system 17.

Overall Circuit Construction

Figure 2:
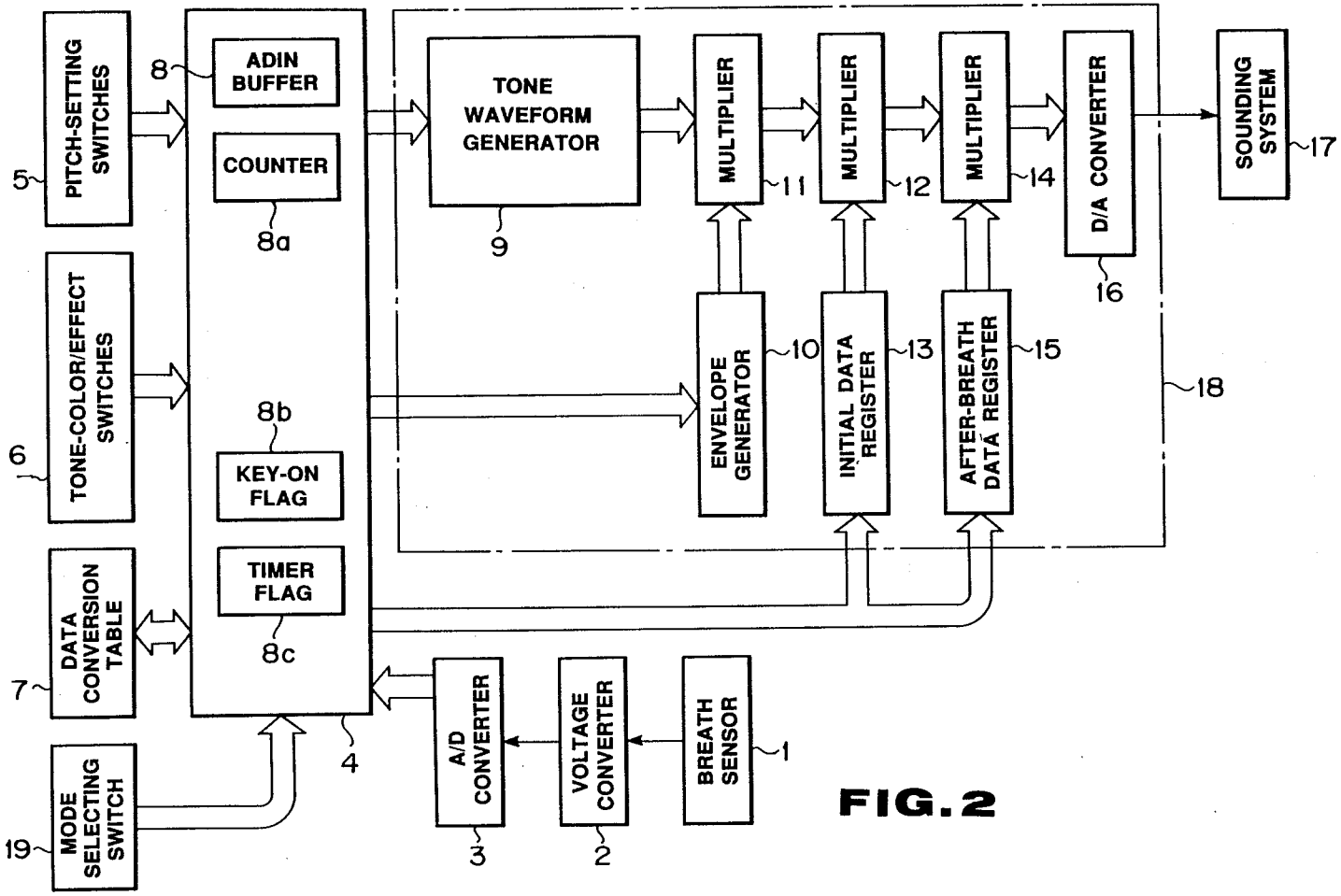
FIG. 2 is a block diagram showing an overall circuit construction used in the embodiment.

FIG. 2 is an overall circuit construction of the embodiment. Inside mouthpiece MP of electronic wind instrument body KG, there is provided breath sensor 1 for detecting the breath operation force provided by the player, i.e., the breathing force or amount of breathing. As breath sensor 1 may be used one, in which a coil bobbin is moved to vary a voltage output according to the breathing force sensed.

The breath detection signal from breath sensor 1 is converted by voltage converter 2 into a corresponding voltage value. This voltage value is converted by A/D converter 3 into digital breath data which is supplied to central processing unit (hereinafter referred to as CPU) 4. CPU 4 controls the operation of the electronic wind instrument circuit. To CPU 4 are supplied pitch signals from pitch-setting switches 5 for setting pitches of tones to be generated and output signals tone-color/effect switches 6 for switching the tone color of tones and various control effects provided to the tones.

Figures 3, 4:
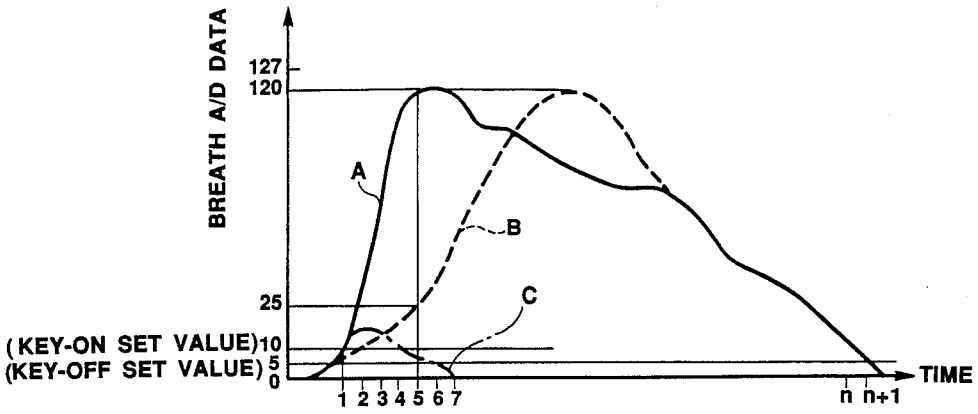
FIG. 3 is a view showing characteristic curves A and B of digital breath data varying with the lapse of time.
FIG. 4 is a view showing an example of conversion contents of breath-data-to-initial-data conversion table.

To CPU 4 is connected breath-data-to-initial-data conversion table 7 for converting data from A/D converter 3 into digital initial data. The tone volume level of the tone is determined according to digital initial conversion data provided from breath-data-to-initial-data conversion table 7. FIG. 4 shows an example of the contents of breath-data-to-initial-data conversion table 7. In this example, the table contents are set such that digital breath data corresponding to the strength of the breathing force is linearly changing initial data. However, it is possible to permit suitable conversion of the breath data into non-linear initial data to obtain a special effect. It is possible to use a lead-only memory (ROM) in lieu of conversion table 7. More simply, conversion table 7 may be dispensed with, and digital breath data may be used as initial breath data.

CPU 4 controls tone waveform generator 9 for tone waveform generation with respect to the wind instrument operation by operating internal ADIN buffer 8, counter 8*a*, etc. ADIN buffer 8 serves to temporarily store digital breath data (0 to 127) provided from A/D converter 8. When the digital breath data (0 to 127) exceeds a preset value (10), counter 8*a* starts counting, and after predetermined counting it informs CPU 4 of the end of counting. Further, CPU 4 supplies a control signal to envelope generator 10 for the generation of an envelope waveform signal determining waveform envelope lines such as attach, decay, sustain, release of the tone waveform.

The tone waveform signal provided from tone waveform generator 9 is multiplied in multiplier 11 with an envelope waveform signal from envelope generator 10.

CPU 4 is controlled such as to generate initial breath data for determining the tone volume level at the time of the tone generation. After the tone generation, it is controlled to generate after-breath data for determining the tone volume level of the tone to be generated.

The tone waveform signal from multiplier 11 is multiplied in multiplier 12 by initial breath data from initial data register 13 controlled by the output from CPU 4. The tone waveform signal provided from multiplier 11, provided by control according to the initial breath data, is multiplied in multiplier 14 by after-breath data from after-breath data register 15 which is similarly controlled by the output of CPU 4. The tone waveform signal from the multiplier 14, provided by control according to the after-breath data, is converted by D/A converter 16 into an analog signal to be sounded as audio signal from sounding system 17.

Mode selection switch 19 constitutes mode selection means for selecting either a first or a second play mode in initial data generation to be described later. When a signal for selecting a first or a second play mode is supplied from mode selection switch 19, CPU 4 controls a tone parameter of the tone to be generated from tone generator 18 according to each play mode. When the first play mode is selected by mode selection switch 19, the tone volume of the tone at the time of the tone generation is determined according to digital breath data or initial data detected by breath sensor 1. When the second play mode is selected, the tone volume of the tone at the time of the tone generation is determined independently of the digital breath data from breath sensor 1 or initial breath data but according to a predetermined numerical value, i.e., the maximum value of initial breath data.

Tone waveform generator 9, envelope generator 10, multipliers 11, 12, 14, initial data register 13, after-breath data register 15 and D/A converter 16 constitute a tone generator 18. In this embodiment tone generator 18 is provided together with sounding system 17 in electronic wind instrument body KG, but alternatively they may be provided separately from and electrically connected to electronic wind instrument body KG.

Operation

Now, the operation of the embodiment having the above construction will be described.

General Routine of CPU

Figure 5:
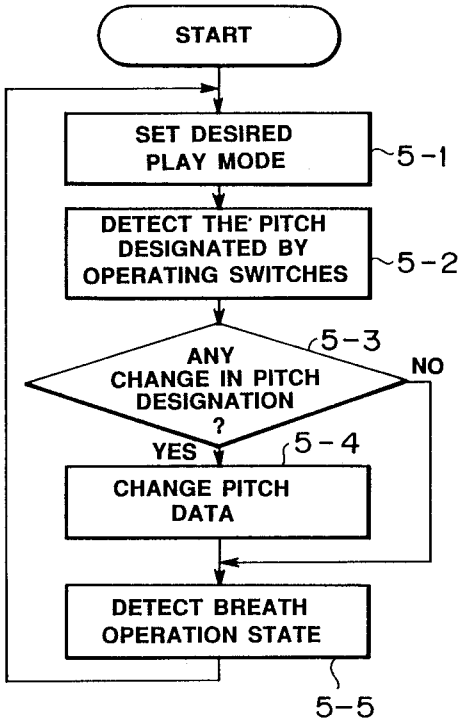
FIG. 5 is a flow chart showing a general routine executed by a CPU.

FIG. 5 shows a general routine of CPU 4.

When the power source is closed, CPU 4 first executes step 5-1, in which it detects switch selection states of mode selection switches 19 and effects play mode setting according to the detected switch selection states. Then, in step 5-2 CPU 4 performs a pitch designation operation state detection process for detecting the pitch designation operation state of pitch-setting switches 5. Then, in step 5-3 a check is done as to whether there has been a change in the pitch designation operation state. If there has been a change, a pitch designation operation state change process is executed for changing pitch data to corresponding pitch data. If no change is detected, the pitch data is not changed. Then, in step 5-5 a breath operation state detection process is performed to detect a breath operation state provided by the player.

Play Mode Setting Process

Figure 6:
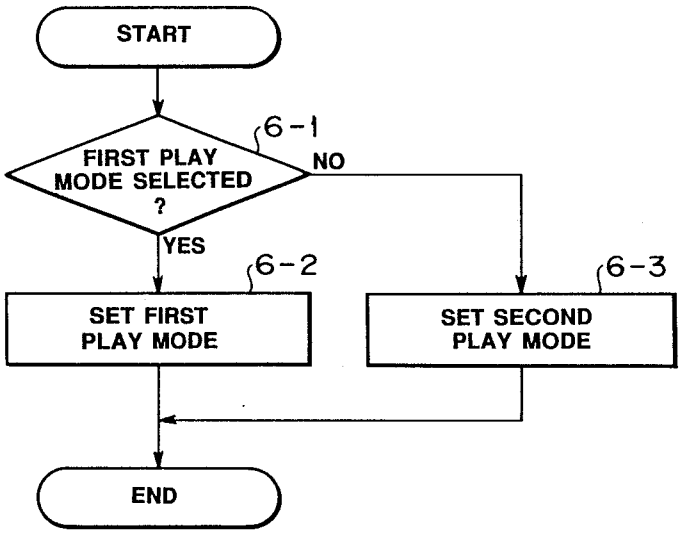
FIG. 6 is a flow chart showing a routine for setting a play mode.

FIG. 6 shows details of play mode setting process 5-1.

First, in step 6-1 CPU 4 reads in the switch selection state of mode selection state 19 and effects a check as to whether the first play mode has been selected. If it is detected that the first play mode has been selected, CPU 4 executes step 6-2 of a first play mode setting process to set the first play mode. If it is detected that the first play mode has not been selected, CPU 4 executes step 6-3 of a second play mode setting process to set a second play mode. The execution of the first or second play mode setting process brings an end to this routine.

Time Characteristics of Digital Breath Data

Now, prior to explaining the detailed operation of this embodiment, an example of time characteristics of digital breath data will be described.

FIG. 3 is a graph showing time characteristics of digital data obtained after conversion of analog breath data from breath sensor 1 in A/D converter 3 into digital signal. The abscissa is taken for for the time elapsed after the commencement of breath operation, and the ordinate is taken for the value of digital breath data (of 0 to 127 with a 7-bit resolution of A/D converter 9). In the Figure, characteristic curve A is provided when a strong breathing force is given from the outset. Characteristic B is provided when the breathing force is gradually increased. Characteristic C is provided when a noise breathing force input without any musical performance purpose is detected.

When First Play Mode Is Set

The detailed operation of this embodiment will now be described in connection with a case when the first play mode is set and a case when the second play mode is set.

First, the case when the first play mode is set will be described.

Figure 7:
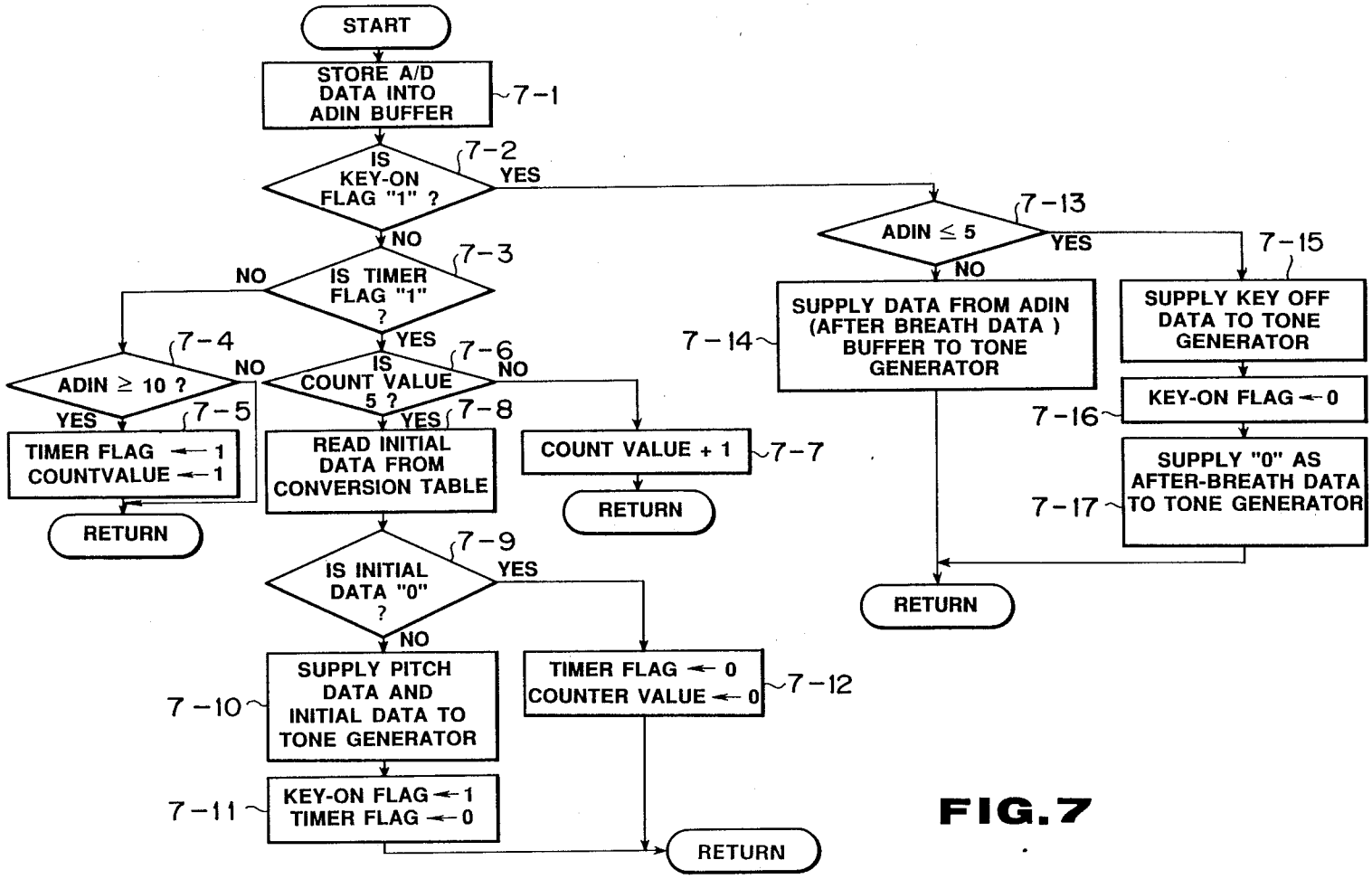
FIG. 7 is a flow chart showing a tone parameter control when setting a first play mode.

FIG. 7 is a flow chart for tone control when the first play mode is set. This routine is executed at a predetermined time interval, and it may be started at an interval of 0.1 to several msec. by timer interruption, if necessary.

In step 7-1, digital breath data provided from A/D converter 3 is stored in ADIN buffer 8 in CPU 4. Then, step 7-2 is executed, in which a check is done as to whether a key is "on" (a tone is being generate), i.e., whether key-"on" flag **8*b*** is "1".

If the key-"on" is "1", after closure of the power source, a decision NO is produced, and the routine goes to step 7-3, in which a check is done as to whether timer flag **8*c* is "1". Since counter 8*a* in CPU 4 is not counting, a decision NO is again produced in this step. The routine thus goes to step 7-4, in which a check is done as to whether the value of digital breath data having been stored in ADIN buffer 8 is no less than 10, which is the threshold level (preset key-"on" level) of commencement of tone generation shown in FIG. 3. If a decision NO is produced, there is no need of sounding, so that the routine is returned to the main routine. If the digital breath data exceeds level 10 at time 1 in FIG. 3, the routine goes to step 7-5, in which timer flag 8*c* is set to "1" and also the count of counter 8*a* in CPU 4** is set to "1" to start counting. Then, the routine is returned to the main routine.

Subsequently, at time 2 in FIG. 3 steps 7-1 through 7-3 described above are executed. Since this time timer flag **8*c* has been set to "1", a decision YES is provided, and the routine goes to step 7-6. In step 7-6, a check is done as to whether the count of counter 8*a* is "5", which is the time for generation of initial data. Since the count is still "1", the decision is NO, and the routine goes to step 7-7** to increment the count by "1". The routine then is returned to the main routine.

In this way, steps 7-1 through 7-7 are repeatedly executed. When the count of counter **8*a* becomes "5", the routine goes to step 7-8 for generation of initial data. In step 7-8, breath-data-to-initial-data conversion table 7 is accessed according to the value of digital breath data in ADIN buffer 8** at that time.

In the example shown in FIG. 3, when data in ADIN buffer 8 of characteristic A at the time corresponding to count "5" of timer counter **8*a* is "120", initial data after the conversion is "124". When data in ADIN buffer 8 of characteristic B at the time corresponding to count "5" in FIG. 3 is "25", initial data after conversion through conversion table 7 is as small as 40**.

Then, in step 7-9 a check is done as to whether the present initial data is "0". Since the inidital data corresponding to characteristics A and B are "124" and "40" and not "0", the routine goes to step 7-10. In step 7-10, CPU 4 supplies pitch data obtained by detection of the operation state of pitch-setting switches 5 and initial data ("124" and "40") to tone generator 18. More specifically, values "124" and "40" of initial data are supplied to initial data register 13. Then, in response to key-"on" data generated at the start of counting, the tone waveform signal provided from tone waveform generator 9 and envelope waveform signal from envelope generator 10 are multiplied in multiplier 11. Since the multiplied tone waveform signal from multiplier 11 is supplied to multiplier 12, the values "124" and "40" showing initial breath data supplied to initial breath data register 13 are multiplied in multiplier 12.

Figure 9A:
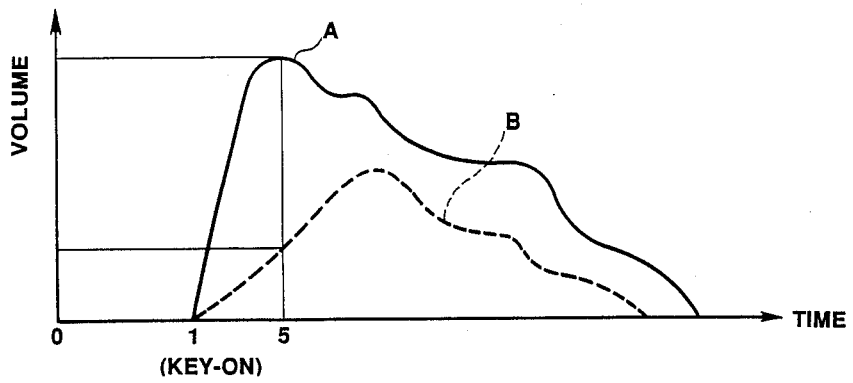
FIG. 9*a* is a view showing characteristic curves A and B of tone volume controlled in the first play mode.

For this reason, tone is generated with a volume corresponding to characteristic A or B in FIG. 3 as shown in FIG. **9*a*, the initial data value is "124", so that the tone is generated with a volume corresponding to the value of "124" (see characteristic A in FIG. 9*a***). In the case of characteristic B, the initial data value is "40", the tone is generated with a volume corresponding to the value of "40" (see characteristic B in FIG. 9*a*).

After the pitch data and initial data have been supplied to tone generator 18, step 7-11 is executed, in which key-"on" flag 8*b* is set to "1", and timer flag 8*c* is set to "0" to be ready for the start of counting. Then, the routine is returned to the main routine.

In the case of characteristic C in FIG. 3, i.e., when an input irrelevant to any musical performance but due to noise is detected as digital great data, it is determined in step 7-9 that initial data corresponding to count "5" is "0". Therefore, in such a case, it is determined that there is no musical performance input. It is thus possible to prevent occasional commencement of tone generation. After the pitch data and other data have been supplied to tone generator 18, step 7-12 is executed, in which timer flag 8*c* for initialization and count of counter 8*c* are both set to "0", and the routine is returned to the main routine.

If it is detected in step 7-2 that a key is being "on", it means that a tone is being sounded, so that no check is done as to whether there is initial data. In step 7-13, a check is done as to whether data in ADIN buffer 8, having been stored in step 7-1, is greater than 5, i.e., a preset key-"off" level. If the decision of the chick is NO, it is necessary to control the tone being sounded according to after-breath data. Thus, in step 7-14 data in ADIN buffer 8 is supplied as after-breath data to tone generator 18. More specifically, the after-breath data is supplied through after-breath data register 15 to multiplier 14. Thus, multiplier 14 multiplies the after-breath data and tone waveform signal from multiplier 12 by each other. Thus, the tone parameter after the tone generation is controlled after the after-breath data, and the routine is returned to the main routine.

If a decision YES is produced in step 7-13, a process of muting the tone being produced has to be executed. Thus, in step 7-15 key-"off" data is provided to tone generator 18. Then, in step 7-16 key-"on" flag 8*b* is set to "0". Further, in step 7-17 "0" is supplied as after-breath data to tone generator 18, and then the routine is returned to the main routine.

When the wind instrument operation is done with characteristic A in FIG. 3 in the first play mode, i.e., in case when the player provides a strong breathing force from the outset and gradually reduces the breathing force, the generation of a desired tone is controlled with a characteristic A in FIG. 9*a* with respect to the breath operation state. Even in this case, when the value "120" of initial breath data is large, a tone having a high attach is produced as shown by curve A in FIG. 3. After the reaching of the peak value, the tone is controlled according to the after-breath data, so that it is possible to obtain a tone which is reduced gradually. Further, when the breath operation is done with a characteristic B shown in FIG. 3, i.e., in case when the player provides a weak breathing force at the outset and then gradually increases the breathing force to reach the peak level and reduces again the breath operation force, tone control with curve B in FIG. 9*a* is obtained in correspond to the wind instrument operation state. In this case, if initial breath data of value "40" is comparatively small as shown by curve B in FIG. 9*a*, the tone generated from the commencement of counting has a comparatively weak attack. When the initial breath data value is small at the commencement of tone generation, the tone volume level of the tone to be generated is determined with that small value. Therefore, even when the player gradually increases the breathing force after the commencement of the tone generation up to a peak level, the tone volume level according to the initial breath data is multiplied only by the after-breath data. For this reason, the tone volume level never reaches the peak level. For this reason, the change interval of the tone volume level is reduced after the commencement of the tone generation.

Further, when noise wind instrument operation having a characteristic as shown by curve C as shown in FIG. 3 is performed, no tone is generated since initial breath data at time corresponding to count "5" of counter 8*a* is "0". For this reason, when there is a wind instrument operation based on such cause as casual breathing, it is possible to prevent generation of unnecessary tone.

When Second Play Mode Is Set

Now, the case when the second play mode is set will be described.

Figure 8:
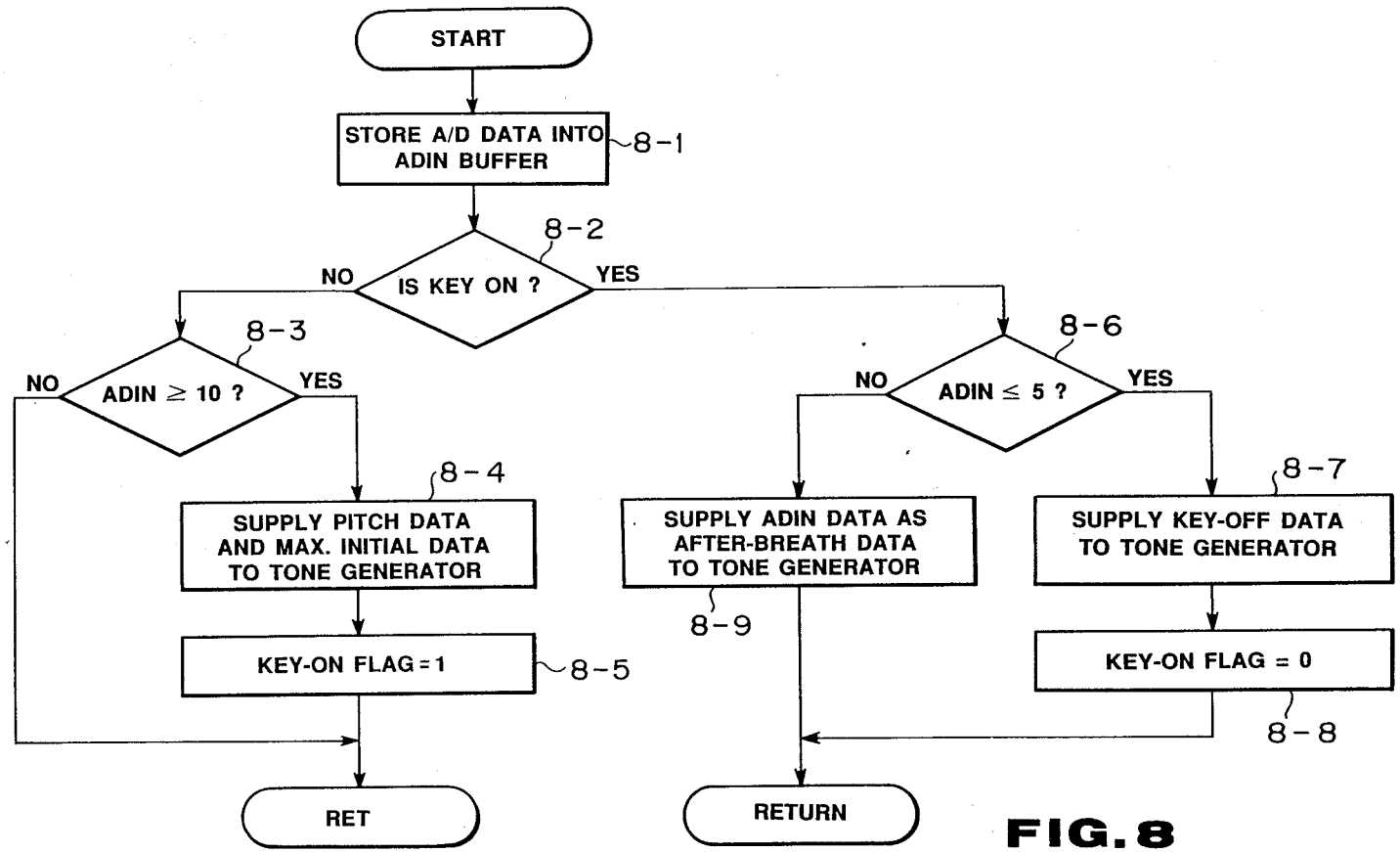
FIG. 8 is a flow chart showing a tone parameter control when a second play mode.

FIG. 8 is a flow chart for tone control when the second play mode is set.

In step 8-1, data obtained after conversion of the output signal of A/D converter 3 through conversion table 7 is read into ADIN buffer 8 in CPU 4. Subsequently, in step 8-2 a check is done as to whether a key is being "on", i.e., key-"on" flag 8*b* is set to "1".

When key-"on" flag 8*b* is initialized in the main routine, a decision NO is produced, and in step 8-3 a check is done as to whether the data stored in ADIN buffer 8 is no less than level "10" as preset key-"on" value shown in FIG. 3.

If the decision is NO, it is regarded that there is no breath operation input, and the routine is returned to the main routine. If the data level is above "10" at count time 1 as shown in FIG. 3, step 8-4 is executed, in which pitch data set by operation of pitch-setting switches 5 and a value corresponding to the maximum value of "127" as initial data are supplied to initial data register 13 in tone generator 18. Initial data is provided from initial data register 12 to multiplier 12.

Thus, when the second play mode is set, the value corresponding to the maximum value of "127" as initial breath data is supplied at all time from initial data register 13 to multiplier 12. In the second play mode, multiplier 12 and initial data register 13 are therefore, the initial data values "120" and "40" stored in multiplier 12 and initial data register 13 are not used as data for controlling the tone volume as a tone parameter.

In subsequent step 8-5, key-"on" flag 8*b* is set to 1, and the routine is returned to the main routine.

If it is decided in step 8-2 that a key is being "on", a check is done in step 8-6 as to whether data stored in ADIN buffer 8 is no greater than "5" as a preset key-"on" level. If the data is greater than "5" at count time n+1 as shown in FIG. 3, the tone being sounded is be muted. Thus, in step 8-7 key-"off" is provided to tone generator 18, and in subsequent step 8-8 key-"on" flag 8*b* is set to "0" before the routine is returned to the main routine.

If a decision NO is produced in step 8-6, the tone sounding is continued, and it is necessary to control the tone parameter of the tone being sounded according to after-breath data. Therefore, it is necessary to generate after-breath data for the tone parameter control. Hence, in step 8-9 ADIN data stored in previous step 8-1, i.e., initial data, is supplied as after-breath data to tone generator 18. More specifically, the data is supplied to after-breath data register 15. The digital breath data stored in after-breath register 15 is multiplied in multiplier 14 by a tone waveform signal. The routine is then returned to the main routine.

Figure 9B:
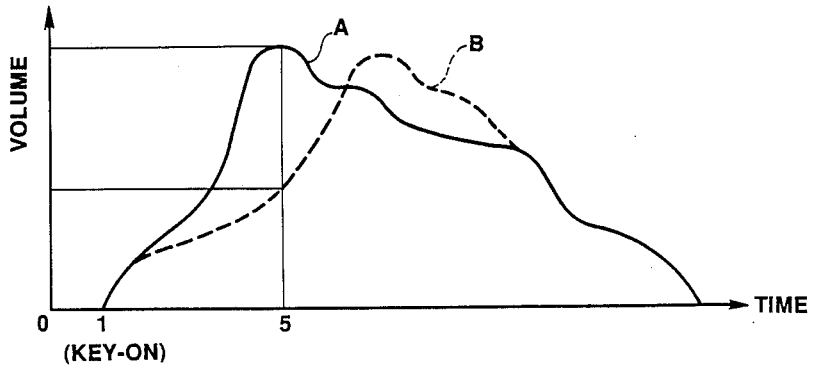
FIG. 9*b* a view showing characteristic curves A and B of tone volume controlled in a second play mode.

In this way, when the player provides a strong breathing force from the outset as curve A of the time characteristic of digital breath data as shown in FIG. 3, a tone having a volume change characteristic substantially corresponding to the strength of the actual breath operation input is sounded. When the player first gives a weak breathing and gradually increases the breathing force as shown by curve B in FIG. 3 up to a peak value like characteristic A, the tone volume level first rises gradually in the attach, then gradually increased to the peak level and then gradually attenuated and muted in a subsequent attenuation step as shown by characteristic B shown in FIG. 9*b*. When by arranging such that when a tone color of a continuous tone system is selected depending on the kind of the tone color of the tone to be sounded, the second play mode is automatically selected, and consequently when the tone color of the attenuating tone system of piano or the like is selected, the first play mode is automatically set, it is possible to obtain play with tones having volume change characteristics suited to the tone color.

Other Embodiments

In the above embodiment, tone generator 18 is provided with multipliers 11, 12 and 14 for multiplying the tone waveform signal from tone wage generator 9 by various data values to control the tone parameter of the tone being generated, this structure is by no means limitative. Further, it is possible to omit mode selection switch 19.

The above embodiment has concerned with saxophonelike wind instrument body KG, and this is by no means limitative; for example, the invention may be applied as well to brass instruments such as trumpets and trombones and wood wind instruments such as clarinets and oboes.

In the above embodiment the tone volume of the tone to be generated and tone volume of the tone being generated are controlled according to initial breath data and after-greath data. For example, according to initial breath data and after-breath data the tone color or pitch of the tone to be or being generated.

In the above embodiment, wind instrument body KG is provided with mouthpiece MP, pitch-setting switches 5 and sounding systems 17. However, it is possible to provide mouthpiece MP, pitch-setting switches 5 and sounding system 17 may be provided on the outer side of wind instrument body KG.

Further, in this embodiment, only a single initial data conversion table 7 is provided. However, it is possible to provide a plurality of different initial data conversion tables to be selected depending on the tone selection of the like.

What is claimed is:

1. An electronic instrument comprising:

air flow sensor means for detecting an air flow state induced by a player and for producing a corresponding analog detection signal;

analog-to-digital conversion means for converting the analog detection signal detected by said air flow sensor means to a corresponding digital detection signal;

time-counting means for counting a first time instant when the value of the digital detection signal from said analog-to-digital conversion means exceeds a preset value and for counting a second time instant when a predetermined time is elapsed from said first time instant;

tone generation commencement designation means for providing a tone generation commencement designation signal for designating the commencement of tone generation in response to said first time instant counted by said counting means;

initial data generation means for generating initial data at the commencement of the tone generation according to the value of said digital detection signal at said second time instant counted by said time-counting means; and tone parameter control means for providing initial data generated by said initial data generation means and for controlling a tone parameter at the commencement of the tone generation according to said initial data.

2. An electronic instrument according to claim 1, wherein said time-counting means comprises counting means for starting the counting when the value of the digital detection signal from said analog-to-digital conversion means and for indicating an end of counting after counting for a predetermined period of time.

3. An electronic instrument according to claim 1, wherein said initial data conversion means comprises conversion table means for converting the digital detection signal from said analog-to-digital conversion means to a corresponding digital value.

4. An electronic instrument according to claim 1, which further comprises:

after-data generation means for generating digital after-data generated after the generation according to the value of the digital detection signal from said analog-to-digital conversion means; and tone parameter control means for providing after-data generated from said after-data generation means and for controlling a tone parameter after the tone generation.

5. An electronic instrument according to claim 1, wherein said initial data generation means includes initial data conversion means for converting the value of said digital detection signal from said analog-to-digital conversion means to predetermined digital initial data.

6. An electronic instrument according to claim 5, wherein said initial data conversion means includes conversion table means for converting said digital detection signal from said analog-to-digital conversion means to predetermined digital initial data.

7. An electronic instrument according to claim 1, wherein said tone parameter control means controls a tone parameter representing the tone volume level or tone color contents of the tone to be generated according to digital initial data generated by said initial data generation means.

8. An electronic instrument according to claim 4, wherein said tone parameter control means produces a tone parameter control signal for controlling a tone parameter representing the tone volume level and tone color content of the tone being generated according to digital after-data generated by said after-data generation means.

9. An electronic instrument according to claim 1, which further comprises tone generation stop designation means for designating stopping of said tone when the value of the digital detection signal from said analog-to-digital conversion means drops below a predetermined value after a predetermined tone has been generated.

10. An electronic instrument according to claim 1, which further comprises:

pitch designation means for designating a pitch of the tone to be generated according to a pitch designation operation by a player.

11. An electronic instrument, comprising:

air flow sensor means for detecting an air flow state induced by a player and for producing a corresponding analog detection signal;

analog-to-digital conversion means for converting an analog detection signal provided by said air flow sensor means to a corresponding digital detection signal;

time-counting means for counting a first time instant when the value of the digital detection signal from said analog-to-digital conversion means exceeds a preset value, and for counting a second time instant when a predetermined time is elapsed from said first time instant;

tone generation commencement designation means for providing a tone generation commencement designation signal for designating the commencement of the tone generation in response to said first time instant counted by said counting means;

initial data generation means for generating initial data at the commencement of the tone generation according to the value of said digital detection signal at said second time instant counted by said time-counting means;

tone parameter control means for providing digital initial data generated by said initial data generation means and for controlling the tone parameter at the commencement of the tone generation according to said initial data; and tone generation stop designation means for designating stopping of said tone when the value of the digital detection signal from said analog-to-digital conversion means drops below a predetermined value after a predetermined tone has been generated.

12. An electronic instrument comprising:

air flow sensor means for detecting an air flow state induced by a player and for producing a corresponding analog detection signal;

analog-to-digital conversion means for converting an analog detection signal detected by said air flow sensor means to a corresponding digital detection signal;

time-counting means for counting a first time instant when the value of the digital detection signal from said analog-to-digital conversion means exceeds a preset value, and for counting a second time instant when a predetermined time is elapsed from said first time instant;

tone generation commencement designation means for providing a tone generation commencement designation signal for designating the commencement of the tone generation in response to said first time instant counted by said counting means;

initial data generation means for generating initial data at the commencement of the tone generation according to the value of said digital detection signal at said second time instant counted by said time-counting means;

first tone parameter control means for providing digital initial data generated by said initial data generation means, and for controlling a tone parameter at the commencement of the tone generation according to said initial data; after-data generation means for generating digital after-data after the tone generation according to the value of the digital detection signal provided by said analog-to-digital conversion means after the predetermined tone is generated;

second tone parameter control means for providing after-data generated from said after-data generation means and for controlling a tone parameter after the tone generation;

pitch designation means for designating the pitch of the tone to be generated according to a pitch designation operation by a player.

13. An electronic instrument comprising:

air flow sensor means for detecting an air flow state induced by a player and for producing a corresponding analong detection signal;

analong-to-digital conversion means for converting an analong detection signal provided by said air flow sensor means to a corresponding digital detection signal;

time-counting means for counting a first time instant when the value of the digital detection signal from said analog-to-digital conversion means exceeds a present value and for counting a second time instant when a predetermined time is elapsed from said first time instant;

tone generation commencement designation means for providing a tone generation commencement designation signal for designating the commencement of the tone generation in response to said first time instant counted by said counting means;

initial data generation means for generating inital data at the commencement of the tone generation according to the value of said digital detection signal at said second time instant counted by said time-counting means; and first tone parameter control means for providing digital initial data generated by said initial data generation means, and for controlling a tone parameter at the commencement of the tone generation according to said initial data;

after-data generation means for generating digital after-data generated after generation according to the value of the digital detection signal from said analog-to-digital conversion means; and second tone parameter control means for providing after-data generated from said after-data generation means and for controlling a tone parameter after the tone generation;

tone generation stop designation means for designating stopping of said tone when the value of the digital detection signal from said analog-to-digital conversion means drops below a predetermined value after a predetermined tone; and pitch designation means for designating a pitch of the tone to be generated according to a pitch designation operation by a player.

14. An electronic instrument comprising:

air flow sensor means for detecting an air flow state induced by a player and for producing a corresponding analog detection signal;

analog-to-digital conversion means for converting an analog detection signal detected from said air flow sensor means to a corresponding digital detection signal;

time-counting means for counting a first instant when the value of the digital detection signal converted by said analog-to-digital conversion means exceeds a preset value and for counting a second instant when a predetermined time interval is elapsed from said first instant;

tone generation commencement designation means for providing a tone generation start designation signal designating the commencement of tone generation in response to said first instant counted by said time-counting means;

initial data setting means functioning such that when generating a predetermined tone according to the tone generation commencement signal provided from said tone generation commencement designation means it sets a predetermined value as initial data independently of the value of the digital detection signal from said analog-to-digital conversion means;

after-data generation means functioning such that after generation of a predetermined tone according to said tone generation commencement signal from said tone generation commencement designation means it generates after-data according to the value of the digital detection signal from said analog-to-digital conversion means; and tone parameter control means for providing said initial data from said initial data setting means for the control of a tone parameter at the commencement of the tone being generated according to said initial data, and for providing, after the commencement of the tone generation, after-data generated from said after-data generation means for control of the tone parameter after the tone generation according to said after-data.

15. An electronic instrument according to claim 14, wherein said initial data setting means comprises preset means for presetting the maximum value of the digital detection signal provided from said analog-to-digital conversion means.

16. An electronic instrument according to claim 14, wherein said time-counting means comprises counting means for starting the counting when the digital detection signal from said air flow sensor means exceeds a predetermined value, and for indicating the end of the counting after counting for a predetermined period of time.

17. An electronic instrument according to claim 14, wherein said initial data generation means includes initial data conversion means for converting the value of the digital detection signal from said analog-to-digital conversion means to predetermined digital initial data.

18. An electronic instrument according to claim 17, wherein said initial data conversion means includes conversion table means for converting the digital detection signal from said analog-to-digital conversion means to predetermined initial data.

19. An electronic instrument according to claim 14, wherein said tone parameter control means produce a parameter control signal for controlling the tone parameter representing either the tone volume level or tone color content of the tone to be generated according to digital initial data generated from said initial data generation means, and for producing a tone parameter control signal for controlling either the tone volume level or tone color content of the tone being generated according to digital after-data generated from said after-data generation means.

20. An electronic instrument according to claim 14, which further comprises tone generation stop designation means for designating stopping of said tone when the value of the digital detection signal from said analog-to-digital conversion means drops below a preset value after a predetermined tone is generated.

21. An electronic instrument according to claim 14, which further comprises:

pitch designation means for designating a pitch of the tone to be generated according to a pitch-designation operation by a player.

22. An electronic instrument comprising:

air flow sensor means for detecting an air flow state induced by a player and for producing a corresponding analog detection signal;

analog-to-digital conversion means for converting an analog detection signal provided from said air flow sensor means to a corresponding digital detection signal;

time-counting means for counting a first instant when the value of the digital detection signal converted by said analog-to-digital conversion means exceeds a preset value, and for counting a second instant when a predetermined time interval is elapsed from said first instant;

tone generation commencement designation means for providing a tone generation start designation signal designating the commencement of tone generation in response to said first instant counted by said time-counting means;

initial data setting means functioning such that when generating a predetermined tone according to the tone generation commencement signal provided from said tone generation commencement designation means it sets a predetermined value as initial data independently of the value of the digital detection signal from said analog-to-digital conversion means;

after-data generation means functioning such that after generation of a predetermined tone according to said tone generation commencement signal from said tone generation commencement designation means it generates after-data according to the value of the digital detection signal from said analog-to-digital conversion means; and tone parameter control means for providing said initial data from said initial data setting means for the control of a tone parameter at the commencement of the tone being generated according to said initial data, and for providing, after the commencement of the tone generation, after-data generated from said after-data generation means for control of the tone parameter after the tone generation according to said after-data;

tone generation stop designation means for designating stopping of said tone when the value of the digital detection signal from said analog-to-digital conversion means drops below a preset value after the predetermined tone is generated; and pitch designation means for designating a pitch of the tone to be generated according to a pitch-designation operation by a player.

* * * * *